US006107635A

United States Patent [19]

Palathingal

[11] Patent Number: 6,107,635

[45] Date of Patent: Aug. 22, 2000

[54] METHOD FOR PRODUCING HIGH IONIZATION IN PLASMAS AND HEAVY IONS VIA ANNIHILATION OF POSITRONS IN FLIGHT

[76] Inventor: Jose Chakkoru Palathingal, 424 Guadarrama La., Miradero Hills Mayaguez, Puerto Rico 00680

[21] Appl. No.: 09/096,314

[22] Filed: Jun. 11, 1998

[51] Int. Cl.[7] ..... H01J 27/00

[52] U.S. Cl. ..... 250/423 R; 250/505.1; 250/492.1

[58] Field of Search ..... 250/423 R, 505.1, 250/492.1

[56] References Cited

U.S. PATENT DOCUMENTS

| | | | |
|---|---|---|---|
| 5,274,689 | 12/1993 | Palathingal et al. | 378/119 |
| 5,381,003 | 1/1995 | Suzuki | 250/305 |

OTHER PUBLICATIONS

M.D.Rosen et al Physical Review Letters, vol. 54, 1985 p. 106.

J.C.Palathingal et al Physical Review, vol. 51, 1995 pp. 2122–2130.

*Primary Examiner*—Bruce C. Anderson

[57] ABSTRACT

High ionization of atoms and molecules is a requirement in several atomic and plasma studies and studies of radiation spectra, in the production of lasers and in industrial applications of various kinds. Most often, ionization of atoms is limited to the removal of the outermost electrons only, for doing which well-known techniques exist. Extraction of electrons from the core shells strongly bound to the atoms, especially the heavy atoms, is difficult. Removal of these electrons is however necessary to achieve a high level of ionization or total ionization demanded in several applications. The method of the present invention employs positron annihilation in flight as a means of eliminating the electrons of the core shells of atoms, especially in the case of elements of large atomic number, so that total or near-total ionization is possible. The method is particularly relevant in producing inner-shell ionization in plasmas and assembles of heavy ions.

16 Claims, 3 Drawing Sheets

METHOD FOR PRODUCING HIGH IONIZATION IN PLASMAS AND HEAVY IONS VIA ANNIHILATION OF POSITRONS IN FLIGHT

FIELD OF THE INVENTION

This invention relates to the ionization of atoms, and more specifically the total or near-total ionization of atoms, the heavy atoms in particular. Ionization of atoms and molecules is usually done by removing electrons from the outer shells of the atoms. Total or heavy ionization of atoms requires removal of core electrons, and is difficult to accomplish especially with heavy atoms. The present invention envisages total or near total ionization of atoms by positron annihilation in flight.

BACKGROUND OF THE INVENTION

Ionizing atoms and molecules can be achieved by any one of a number of means that have been in vogue in the past, and are well understood. These include heating up the medium in the vapor state to high temperatures so that thermal collisions may eliminate some of the electrons. The least-bound of the atomic electrons are naturally the most likely to be removed. Removal of inner shell electrons, particularly of heavy atoms, requires temperatures that are not normally reached especially for any meaningful length of time. Exposing the medium to extremely intense electromagnetic radiation is an alternate technique. These are represented by photons, which are generally of low energy, and there is little possibility that inner-shell electrons are removed from the atoms by absorption of these photons. Yet, M. D. Rosen et al (Physical Review Letters, Vol. 54, 1985, page 106) describe an exploding foil technique by which Se atoms are highly ionized in an uncontrolled manner by irradiating a microfoil of selenium with an extremely powerful burst of laser light. Synchrotron radiation offers photons of a higher range of energy, yet the possibility of producing inner shell ionization at any significant level is very limited. Hard X rays or gamma radiation could create inner-shell ionization via photoelectric effect or internal conversion, but applying the technique to a large assembly of atoms or molecules is beset with practical problems. Yet another possibility is the use of charged particle beams. Charged particle interactions at high energies can create vacancies in the inner shells, but occurring rather rarely.

The most common process wherein a positron incident on a material is annihilated takes place when the positron has come to rest in the material; and is called annihilation at rest. The positron gets annihilated along with an outer-shell electron of the atom at near zero momentum, and two 511-keV photons are emitted in mutually opposite directions. The strongly bound inner shell electrons are not involved in positron annihilation at rest. However it has been known for decades that a positron may be annihilated also while it is in flight, although relatively rarely, in which case a core electron of an atom can be involved. The annihilation of an electron-positron pair during the flight of the positron shall occur with emission of a single photon or a multiple of photons. Annihilation with emission of a single photon takes place in the Coulomb field of the nucleus via interaction of a bound electron. Owing to the proximity of the K electron with the nucleus, the process produces vacancies predominantly in the K shell, followed in decreasing order of probability by the L, M, and the other atomic shells. Various aspects of the phenomenon have been studied recently, and the trends clearly established. Annihilation in flight with two or more photons however occurs differently, wherein all electrons of an atom are equally affected. This process is significant only for emission of two photons, emission of higher number of photons being negligibly rare.

By a recent detailed experimental studies of single-quantum annihilation, a particularly significant component of positron annihilation in flight, it has been observed by J. C. Palathingal et al (Physical Review, Vol. 51, 1995, pages 2122–2130) that the cross section depends on the atomic number Z of the element as roughly $Z^5$. Two-quanta annihilation has a cross section dependance that is proportional to Z in first order, and presents approximately the same cross section per electron irrespective of the shell it belongs to. This cross section per electron is also more or less invariant between the elements, but depends on the positron energy. Although the cross section per atom for two-quanta annihilation in flight is several times larger than for single quantum annihilation, the combined cross section per electron for annihilation in flight is largest for the K electron and decreases in an orderly manner for electrons in the outer shells, as seen in Table 1. Annihilation in flight as a process of ionization hence favors the elimination of electrons from the innermost shells, especially for the heaviest atoms.

SUMMARY OF THE INVENTION

The present invention envisages the use of positron annihilation in flight as a technique of ionization of an assembly or beam of atoms which directly addresses the problem of inner-shell ionization. The method is in principle applicable for any element in any chemical or physical state. A particular object of the invention is to produce completely ionized atoms, preferably heavy atoms, by removing all the electrons. Table 1. Annihilation-flight cross sections (in barn) for positrons of energy 300 keV for selected heavy and medium-heavy elements. Single-quantum annihilation cross sections are noted with the subscript$_{SQA}$ for the K, L, and M shells. The two-quanta annihilation cross section per atom is noted by the subscript$_{TQAF}$. The combined cross section per electron for the K, L, and M electrons is noted by the subscript$_e$.

| Z | $\sigma_{SQA}$ (K) | $\sigma_{SQA}$ (L) | $\sigma_{SQA}$ (M) | $\sigma_{TQAF}$ (a) | $\sigma_e$(K) | $\sigma_e$(L) | $\sigma_e$(M) |
|---|---|---|---|---|---|---|---|
| 92 (U) | 0.92 | 0.24 | 0.06 | 7.7 | 0.54 | 0.12 | 0.086 |
| 82 (Pb) | 0.54 | 0.14 | 0.04 | 6.8 | 0.35 | 0.10 | 0.085 |
| 79 (Au) | 0.44 | 0.12 | 0.03 | 6.5 | 0.30 | 0.10 | 0.083 |
| 50 (Sn) | 0.06 | 0.014 | 0.004 | 4.1 | 0.11 | 0.085 | 0.083 |

The feasibility of inner-shell ionization of atoms by positron annihilation in flight is dictated by the cross sections of the process. The theoretical studies of the past and the experimental observations of the recent years have demonstrated that the cross sections are large and favor targets of large atomic number particularly, making the process the most amenable for the heavy elements, difficult targets otherwise for inner-shell ionization. For example, at a positron kinetic energy 300 keV, the K-shell cross section of uranium for single-quantum annihilation of positrons is roughly 0.92 b. The L-shell cross section is approximately ¼th of the K value, and the M-cross section is still lower by about the same factor. The total cross section per U atom for two-quanta annihilation in flight is approximately 7.7 b, roughly equally divided among the 92 electrons of the atom. It may be noted that in a normal heavy atom, there are 2 electrons in the K shell, 8 in the L shell, 18 in the M shell, and additional electrons in the outer shells. Therefore the combined cross section is approximately 0.54 b per K electron of uranium, 0.12 b per L electron, 0.08 b per M electron, and nearly the same per electron of higher order. Consequently, a positron beam irradiating a U target shall be continuously generating ionization of the atoms at a proportion in which the innermost electrons K and L have the greatest shares.

It is noteworthy herein that a vacancy generated in the K shell is readily filled up from a higher shell, the L shell for example, if an electron occupying a higher state is available for transfer. In reality, this means that the effective cross section for a L shell ionization is the sum of the individual cross sections for the K and L shells. Following the argument, it is apparent that the effective cross sections for ionization by positron annihilation in flight is still larger for the other outer shells, all higher than for the K shell. Yet, in achieving high levels of ionization in a medium, it is desirable to begin the positron irradiation after having the outer electrons of atoms already removed from the medium by a conventional method. This is so because removal of the outer electrons can be accomplished by some conventional means more effectively than by positron annihilation. In a preferred mode, therefore, the process of the instant invention consists of removing the outer and middle shell electrons through the use of presently known techniques, followed by removal of inner-shell electrons through the use of positron annihilation in flight.

DESCRIPTION OF A PREFERRED EMBODIMENT

Figure 1:
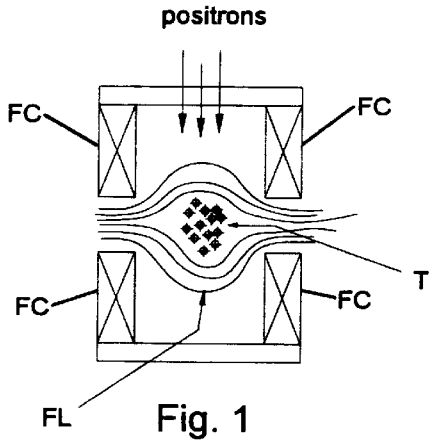
FIG. 1. A plan view illustrating an irradiation setup of a confined plasma or ionized vapor target. In this illustration, the confinement is supposed to be achieved by a magnetic field. The field coils FC are symbolically shown. The presence of induction of any net electric charge in the medium may also necessitate the use of electric field lenses or other devices.

A preferred embodiment is illustrated wherein a specific quantity of atomic material is targeted for ionization by positron annihilation in flight. In this mode, the target material is a microscopic assembly of $10^{10}$ atoms of gold in vapor form, confined to an evacuated space at a low pressure by a bottling device as shown in FIG. 1. For simplicity, the space of confinement is taken to be spherical, of radius 2 cm. The gold atoms are considered to be ionized beforehand, with all electrons in shells of order higher than M being eliminated. The mass density of the assembly of the gold atom is extremely low, $9\times10^{-14}$ g/cm$^3$. The number density of ions is $3\times10^8$/cm$^3$. At this density the average electric field an ion at the outer surface of the vapor body, is 18 kV/cm, which could rise to 28 kV/cm at total ionization, assuming that no free negative charge is present in the region. The effect of internal electric field on the confinement of the ions can be neutralised by the use of suitably-designed electrostatic lenses or other conventional means, along with the magnetic bottling device employed in the spatial confinement of the ions. The working temperature of the confined gold vapor can be well below 3000 K, the boiling point of gold metal at normal pressure. A beam of 300-keV positrons is fanned into a circular cross section of radius 2 cm, and employed to irradiate the vapor target from one side. The beam has to traverse a maximum thickness 4 cm in the target. The positrons lose energy in transit in collision with the gold atoms approximately at the rate 1.3 eV/$\mu$g.cm$^{-2}$. Since the maximum target thickness is only about $3.6\times10^{-13}$ g.cm$^{-2}$, the positrons will lose practically little energy during the transit by collisions with the gold ions; only $4\times10^{-7}$ eV on the average. Some energy loss may occur also due to collisions with the residual atoms resulting from an imperfect vacuum that may exist in the space. Assuming that an ultrahigh vacuum $10^{-10}$ torr can be realised, the number of residual atoms could be around $3\times10^6$/cm$^3$, in which case these atoms could not have a serious adverse effect.

Figure 2:
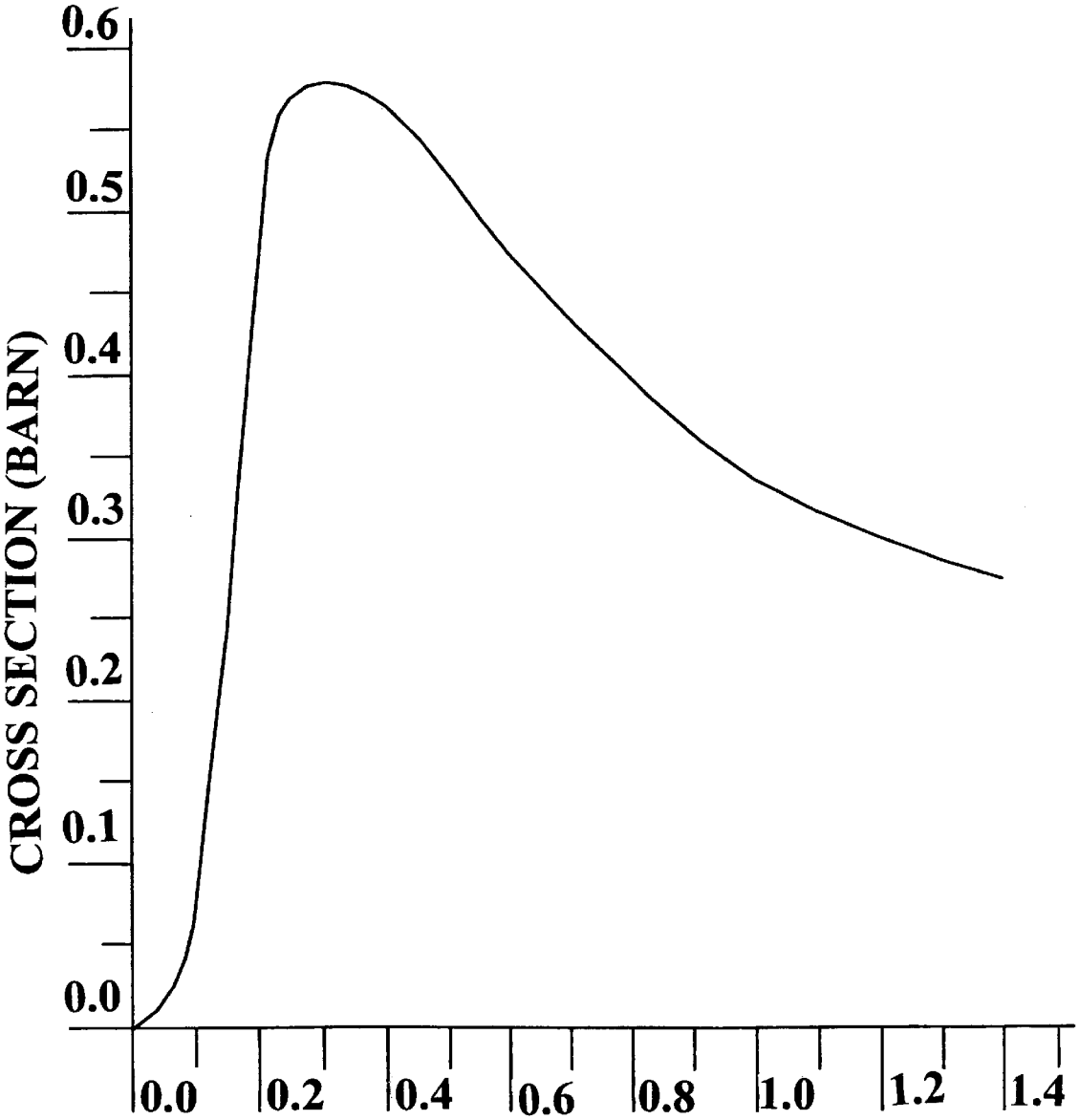
(PRIOR ART) FIGURE 2
FIG. 2. Illustration of the variation of cross section per gold atom for single-quantum annihilation with positron-kinetic energy.
Figure 3:
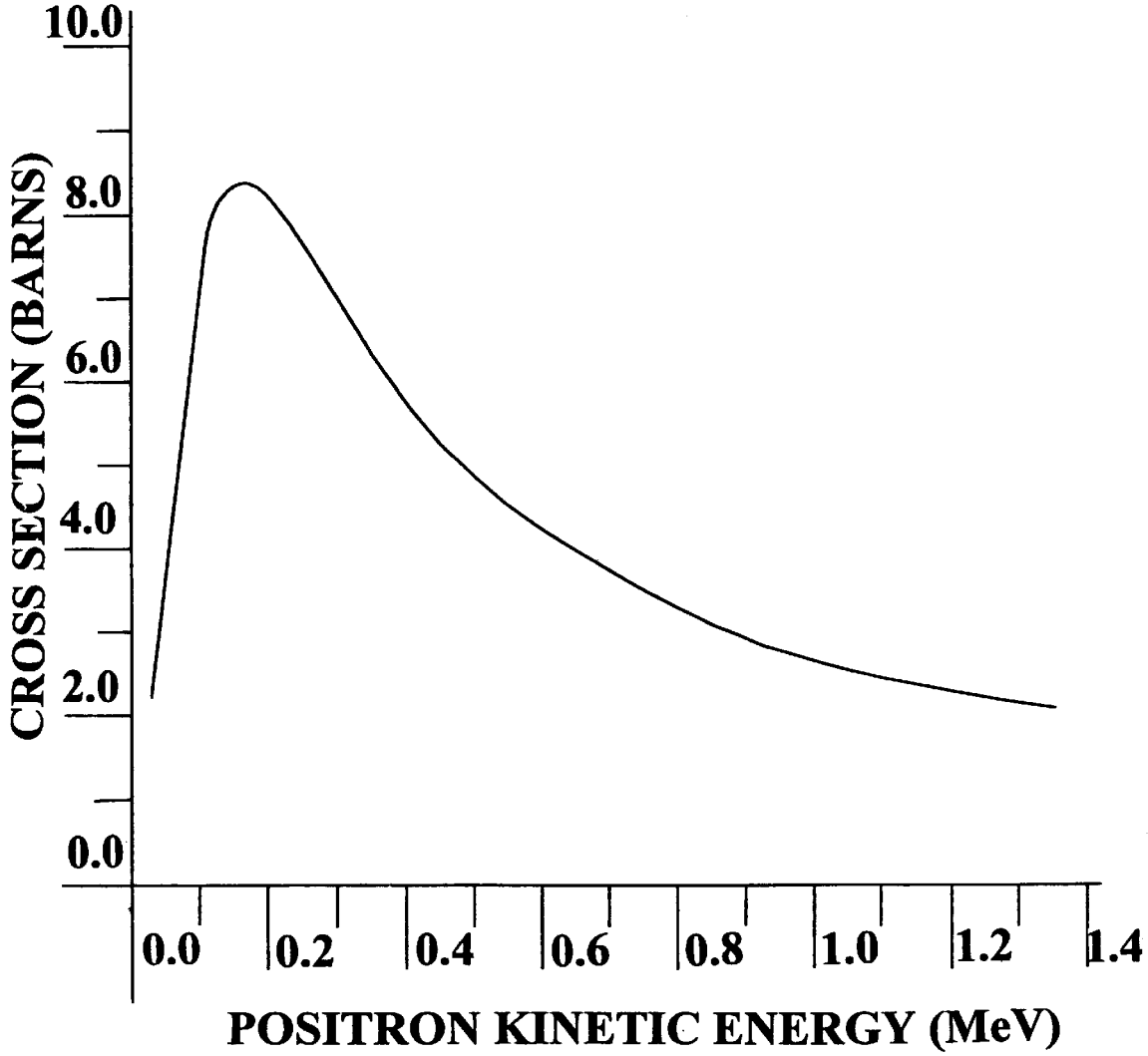
(PRIOR ART) FIGURE 3
FIG. 3. Illustration of the variation of cross section per gold atom for two-quanta annihilation in flight with positron kinetic energy. This cross section is shared nearly equally among the 79 electrons of the atom. Per electron, the cross section for two-quanta annihilation in flight is fairly independent of the target element, but depends on the positron energy.

The kinetic energy of the positrons, 300 keV is an optimum choice taking into account the general desirability of low power beams, minimal generation of heat in the target and large cross sections for annihilation in flight. At this energy, the specific energy loss of positrons for transmission through a heavy element is very near to the minimum, and heat production in the target is minimised. Single-quantum annihilation has the maximum cross section, as seen from FIG. 2, at about 300 keV; specifically, the cross section is 0.44 b for the K shell, 0.12 b for the L shell, and 0.03 b for the M shell. Two-quanta annihilation cross section per electron increases at first with increasing positron-kinetic energy, reaches a maximum at about 150 keV as shown by FIG. 3, and decreases slowly for higher energies. At 300 keV, the two-quanta cross section is 6.5 b, shared equally by the 79 electrons. Combined, the net annihilation in flight cross section is 0.61 b for the K electrons, 0.78 b for the L electrons and 1.5 b for the M electrons. It is seen that two-quanta annihilation in flight can be a significant contributor to the atomic ionization process; in particular in the outer shells as figured in Table 1.

Figure 4:
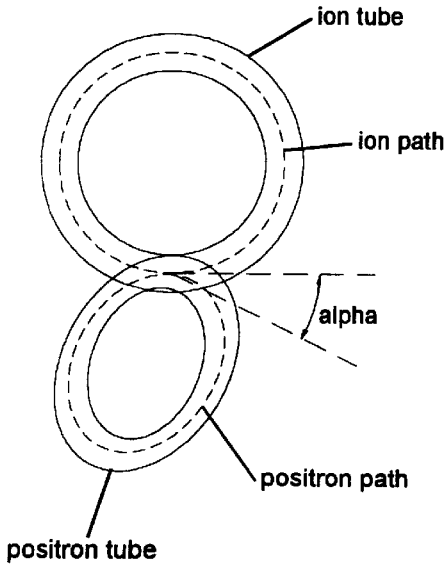
FIG. 4. A plan view illustrating irradiation by a circulating positron beam. The positron beam is derived from a storage ring. The target ions are circulated in a closed path which intercepts the positron beam at an angle $\alpha$. The two closed paths need not be in the same plane, and the angle a may be decided by the requirements of the application intended.

Each incident positron has a probability $7\times10^{-16}$ of being absorbed in the target medium via annihilation in flight directly involving the K shell (having 2 electrons). The probability is about $9\times10^{-16}$ for the L shell (8 electrons) and $1.8\times10^{-15}$ for the M shell (18 electrons). It is hence seen that an integral flux, $3\times10^{24}$ positrons of kinetic energy 300 keV is required to produce on the average one inner-shell vacancy per gold atom in the sample target, under the condition that the gold ions had all the electrons outer to the M shell removed beforehand. The number quoted can be within the current means of feasibility, if a circulating beam of positrons as obtained in a storage ring is used for the irradiation as shown in FIG. 4. The fact that a single transit of the positrons through the rarified gas target causes little change in the energy or divergence of the positron beam is advantageous towards the use of a circulating beam. If the circulation frequency is 10 MHz, a beam flux $3\times10^{17}$ can be adequate. Extended periods of irradiation demand correspondingly lower positron fluxes. Adequately intense beams can be built along the lines of existing machines, at the relatively low positron energies required in this case. The super ACO facility of the University of Paris-Sud provides a positron beam current at the rate $10^{18}$/s.

In relation to the miniscule heat capacity of the target, the quantity of heat generated on account of the kinetic energy of the positrons expended in the target can be enormous. Heat is generated also via the partial absorption by the vapor medium of photons of varied origin created in the medium itself, such as X rays, bremsstrahlung, and gamma photons from positron annihilation in flight. It is assumed that the positron beam emerging from the target continues its path well beyond the target location and the positrons do not have an opportunity to stop in the target vicinity in any appreciable number, expend the kinetic energy and produce a significant flux of 511-keV annihilation radiation.

In the case cited, the thermal energy imparted by positrons is estimated to be 0.2 J over the period of the irradiation. Heat supply by photons is dominated by bremsstrahlung of the positrons. However, the gold atoms of the target are heavily ionised to begin with and are devoid of the outer electrons, which reduces the cross sections for bremsstrahlung production, as well as absorption of the photons. Accepting the total cross section for the production of bremsstrahlung by a 300-keV positron to be 10 b/ion, and the average energy of the bremsstrahlung photon to be 20 keV, the mean energy loss per positron works out to be less than $10^{-9}$ eV, for the present target. Further, only a microscopic fraction of the photon energy is absorbed by the rarified medium, which suggests that absorption of high energy photons does not cause a significant temperature rise. The only major source of energy absorption by the atom comes out to be, by and large, the kinetic energy expended by the positrons in the target. The energy works out to be 120 MeV per atom, adequate to speed up the gold atoms to near relativistic velocities (v/c=0.038). This enormous energy is however the result of a very large number of microscopic energy inputs, typically a small fraction of an eV each, and if the irradiation period could be stretched over significantly, the net heating effect can be small because of concurrent loss of energy by thermal radiation. The probable rise in temperature can be very roughly estimated on the basis of the Stefan's Radiation Law, and shown to be insignificant. The working temperature of the vapor assumed to be below 3000 K may not hence be affected. With a circulating positron beam used, as with a storage ring, the irradiation dose may be stretched to long periods, such as hours, which can further ease the demands on heat removal.

The irradiation of the target medium with 300-keV positrons generate secondary effects in the medium, some of which contribute partially to the ionization process. These secondary effects are generally caused by two-tier events, and are ignored because of expected low probabilities. Ionization produced by high energy photons generated in the target medium belongs to this category.

SOME POSSIBLE APPLICATIONS

Ionization of atoms, in general, find several applications in science and technology, one among which is the study of atoms themselves. Total or near-total ionization, particularly of heavy atoms, enables these applications be more broad-based. The applications include studies of atomic structure, radiations, and interactions between electrons within atoms, and between atoms within molecules.

Positron annihilation in flight as a technique of ionizing atomic assemblies or beams can be applied for the production of highly-ionized plasma, especially of heavy atoms, and in the maintenance of the plasma state of a medium.

The method can be used in the study of plasma. Through electron-positron annihilation, the medium gains positive electric charge progressively that tends to generate instability of the plasma medium. The study of this effect shall provide parallel information on plasma instability.

The removal of core electrons can drastically change the properties of a plasma medium. The transmission character of electromagnetic waves through a plasma can undergo major changes if the inner-shell electrons of the atoms of the medium are wholly or partially eliminated.

The technique also has major potential in the production of heavy ions, especially of total or near-total ionization for use in studies of ion-ion collisions.

Totally-ionized atoms and heavily ionized atoms have particular relevance in the study of materials. Doping materials with such atoms can introduce major perturbations in the impurity regions and cause changes in the material properties.

The method has been described in a particular mode, a preferred mode, and it may not be construed that the given description limits the method in scope and applications. Alternate modes are possible; some examples of which are mentioned below.

The method may be applied to any element, obtained in any physical or chemical state, or composition. The target may be had in any geometrical form or dimensions.

The target may be contained in any manner possible, before, during or after irradiation. The processed medium may be preserved in any practical manner or by any known device.

The irradiation may be done with positrons of any energy, employing any flux, or any geometrical arrangement for irradiation.

The irradiation may be done by a pulse of positrons or a continued input of positrons.

The irradiation can be done to generate any required level of ionization in any medium, as for example a plasma or an atomic beam, beginning with zero degree of pre-ionization or any degree of pre-ionization.

Figure 5:
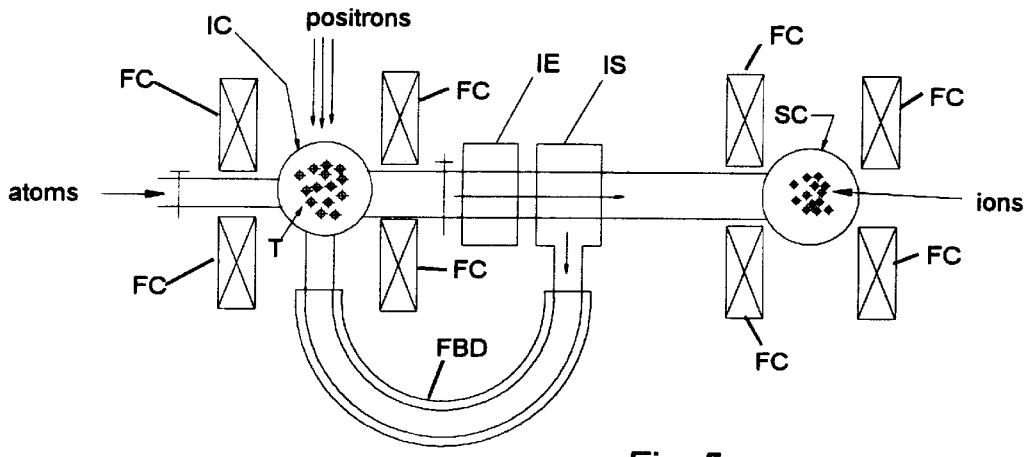
FIG. 5. A plan view illustrating a setup for progressive ionization of an ionized vapor medium. In this illustrative sketch, positrons are shown being incident on the vapor target confined to the irradiation chamber IC maintained at a suitable working temperature. In the preferred mode, positrons travel into the irradiation chamber in the direction perpendicular to the direction of feed through of the target atoms into the chamber and also perpendicular to the direction of feed back of the partially-irradiated atoms. When a large enough assembly of heavily ionized atoms have been accrued, the ions are extracted by an ion extractor device IE which may include an ion accelerator facility and a velocity filter. The ions are then fed into an ion spectrometer IS. Ions having the required level of ionization are then directed into the storage chamber, SC which is provided with a magnetic trap arrangement, according to the illustration. Ions found not to have the required degree of ionization may be fed back by a feedback device FBD into the irradiation chamber IC. The irradiation can be done intermittently or continuously, and charged particles collected into the storage chamber SC, or fed into a stream of ions to augment its ion supply. The ion stream could be a linear beam or a circulating storage ring.

The technique could be applied with or without provision for preservation of the ionization generated. Specifically, in a particular mode, as the ionization builds up to a required level, the ionic atoms may be transferred into an isolated high-vacuum space and retained in the ionized state separated from the walls by means of magnetic and electric bottling devices as illustrated in FIG. 5.

I claim:

1. A method of highly ionizing a collection of atoms, or ions comprising the steps of:

confining the collection of atoms orions to a confined space; and removing a plurality of the inner shell electrons from the collection of atoms by positron annihilation in flight, the step of positron annihilation in flight comprising irradiating the atoms with positrons.

2. The method of highly ionizing of atoms of claim 1, and further comprising the step of:

the positrons being positrons of a beam.

3. The method of highly ionizing a collection of atoms of claim 1, and further comprising the step of:

the positrons having approximately 300 keV kinetic energy.

4. The method of highly ionizing a collection of atoms of claim 1, and further comprising the steps of:

removing a substantial number of the outer-shell electrons of a substantial number of atoms of the collection of atoms by a conventional ionization technique such as heating up the medium containing the atoms in a vapor state to high temperatures; and, removing one or more of the inner-shell electrons from a substantial number of atoms of the collection of atoms by positron annihilation in flight.

5. The method of highly ionizing a collection of atoms of claim 1, and further comprising the step of:

the inner-shell electrons being the electrons of the K, L and M shells.

6. The method of highly ionizing a collection of atoms of claim 1, and further comprising the step of: the collection of atoms are substantially the same type of atoms.

7. The method of highly ionizing a collection of atoms of claim 1, and further comprising the steps of:

the collection of atoms being heavy atoms.

8. The method of highly ionizing a collection of atoms of claim 1, and further comprising the step of:

irradiating the atoms with positrons until the assembly of atoms are substantially completely ionized.

9. The method of highly ionizing a collection of atoms of claim 4, and further comprising the step of:

the positrons being positrons of kinetic energy approximately 300 keV.

10. The method of highly ionizing a collection of atoms of claim 1, and further comprising the step of:

the collection of atoms being a beam of atoms.

11. The method of highly ionizing a collection of atoms of claim 10, and further comprising the step of:

the beam of atoms comprising a beam of ionized atoms.

12. The method of highly ionizing a collection of atoms of claim 10, and further comprising the step of:

the beam of atoms being a circulating beam.

13. The method of highly ionizing a collection of atoms of claim 12, and further comprising the step of:

the positrons being positrons of a beam.

14. The method of highly ionizing a collection of atoms of claim 13, and further comprising the step of:

the beam of positrons being a circulating beam.

15. The method of highly ionizing a collection of atoms of claim 1, and further comprising the step of:

the positrons being positrons in pulse form.

16. The method of highly ionizing a collection of atoms of claim 4, and further comprising the steps of:

first removing outer shell electrons by a conventional technique, and subsequently removing inner shell electrons by positron annihilation in flight.

* * * * *